US007188423B1

(12) United States Patent
Yeh

(10) Patent No.: US 7,188,423 B1
(45) Date of Patent: Mar. 13, 2007

(54) STRUCTURE OF HAIRDRESSING SCISSOR ASSEMBLY

(75) Inventor: Wen-Ya Yeh, Taiann (TW)

(73) Assignee: Yanni Co., Ltd., Tainan (TW)

( * ) Notice: Subject to any disclaimer, the term of this patent is extended or adjusted under 35 U.S.C. 154(b) by 0 days.

(21) Appl. No.: 11/328,912

(22) Filed: Jan. 9, 2006

(51) Int. Cl.
*B26B 13/00* (2006.01)

(52) U.S. Cl. ..... 30/226; 30/254

(58) Field of Classification Search ..... 30/226, 30/227, 254; 403/293, 294, 297, 311, 313
See application file for complete search history.

(56) References Cited

U.S. PATENT DOCUMENTS 4,236,848 A * 12/1980 Rock et al. ..... 403/231
4,341,487 A * 7/1982 Nemecek ..... 403/297
5,875,553 A * 3/1999 Geib et al. ..... 30/226
5,996,592 A * 12/1999 Choy ..... 132/200
6,192,590 B1 * 2/2001 Yeh ..... 30/226
6,257,248 B1 * 7/2001 Yeh ..... 132/213
6,385,851 B2 * 5/2002 Yeh ..... 30/195
6,434,833 B1 8/2002 Yeh
6,601,304 B2 * 8/2003 Yeh ..... 30/226
6,634,106 B2 * 10/2003 Yeh ..... 30/226
2005/0044724 A1 * 3/2005 Lin ..... 30/266

* cited by examiner

*Primary Examiner*—Hwei-Siu Payer
(74) *Attorney, Agent, or Firm*—Pro-Techtor Int'l Services

(57) ABSTRACT

A hairdressing scissor assembly includes plural pairs of hairdressing scissors each having two cutting members pivotally connected together, female and male connectors respectively secured to first and second sides of the pairs of hairdressing scissors for joining the pairs of hairdressing scissors. Each female connector has a through hole for receiving one male connector. Each male connector has a retaining block, which has the maximum outer diameter slightly greater than the through hole of each female connector, so that the retaining block of one male connector at one pair of hairdressing scissors is insertable through the through hole of one female connector at another pair of hairdressing scissors by force and stoppable at one end of the through hole of the associating female connector to have the respective male connector and the respective female connector be fastened together to join the pairs of hairdressing scissors.

5 Claims, 9 Drawing Sheets

STRUCTURE OF HAIRDRESSING SCISSOR ASSEMBLY

BACKGROUND OF THE INVENTION

1. Field of the Invention

The present invention relates to a hairdressing scissor assembly and more particularly, to an improved structure of hairdressing scissor assembly, which improves the drawbacks of the hairdressing scissor assembly of U.S. Pat. No. 6,434,833 B1.

2. Description of the Related Art

U.S. Pat. No. 6,434,833 B1, issued to the present inventor, discloses a pair of hairdressing scissors 1, which comprises two cutting members 10 and 20 pivotally connected together, as shown in FIG. 12. First engaging members 13 and 23 and second engaging members 15 and 25 are respectively provided at the handles of the two cutting members 10 and 20 at two opposite sides. Therefore, two pairs of hairdressing scissors 1 can be secured together by selectively engaging the second engaging members 15 and 25 at the handles of the two cutting members 10 and 20 of one first pair of the hairdressing scissors 1 into the first engaging members 13 and 23 at the at the handles of the two cutting members 10 and 20 of a second pair of the hairdressing scissors 1. This design of the pair of hairdressing scissors 1 is functional, however it still has drawbacks. According to this design, the first engaging members 13 and 23 are sleeves adapted to receive the second engaging members 15 and 25 of another pair of hairdressing scissors 1. During cutting operation, the second engaging members 15 and 25 may easily be forced away from the associating first engaging members 13 and 23, resulting in an operation obstacle. Further, the gap between the two pairs of hairdressing scissors 1 is not adjustable to fit different clients or different hairstyles required, i.e., the hairdressing scissor assembly is not practical for cutting the hair in multiple layers to show a stepped sense of beauty.

SUMMARY OF THE INVENTION

The present invention has been accomplished under the circumstances in view.

According to the present invention, the hairdressing scissor assembly comprises plural pairs of hairdressing scissors. Each pair of hairdressing scissors comprises two cutting members pivotally connected together, at least one female connector secured to at least one of the two cutting members at a first side, and at least one male connector secured to at least one of the two cutting members at a second side opposite to the first side. Each female connector has a through hole for receiving one male connector. Each male connector has a retaining block, which has the maximum outer diameter slightly greater than the through hole of each female connector, so that the retaining block of one male connector at one pair of hairdressing scissor is insertable through the through hole of one female connector at another pair of hairdressing scissors by force and stoppable at one end of the through hole of the associating female connector to have the respective male connector and the respective female connector be fastened together to join the pairs of hairdressing scissors, keeping the tips of the pairs of hairdressing scissors be aligned along a straight line and located at the same level or aligned along an inclined line and located at different levels as desired.

In an alternate form of the present invention, the female connector is made in the form of a splitting ring having a radial crevice extending from the through hole to the periphery of the female connector, so that the female connector can be expanded to let the retaining block of the associating male connector pass and then be stopped at one end of the through hole when passed.

In another alternate form of the present invention, the retaining block of each male connector is made in the form of a block having a radial concave, so that the retaining block of each male connector can be compressed and easily forced through the through hole of the associating female connector and then stopped at one end of the through hole of the associating female connector.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
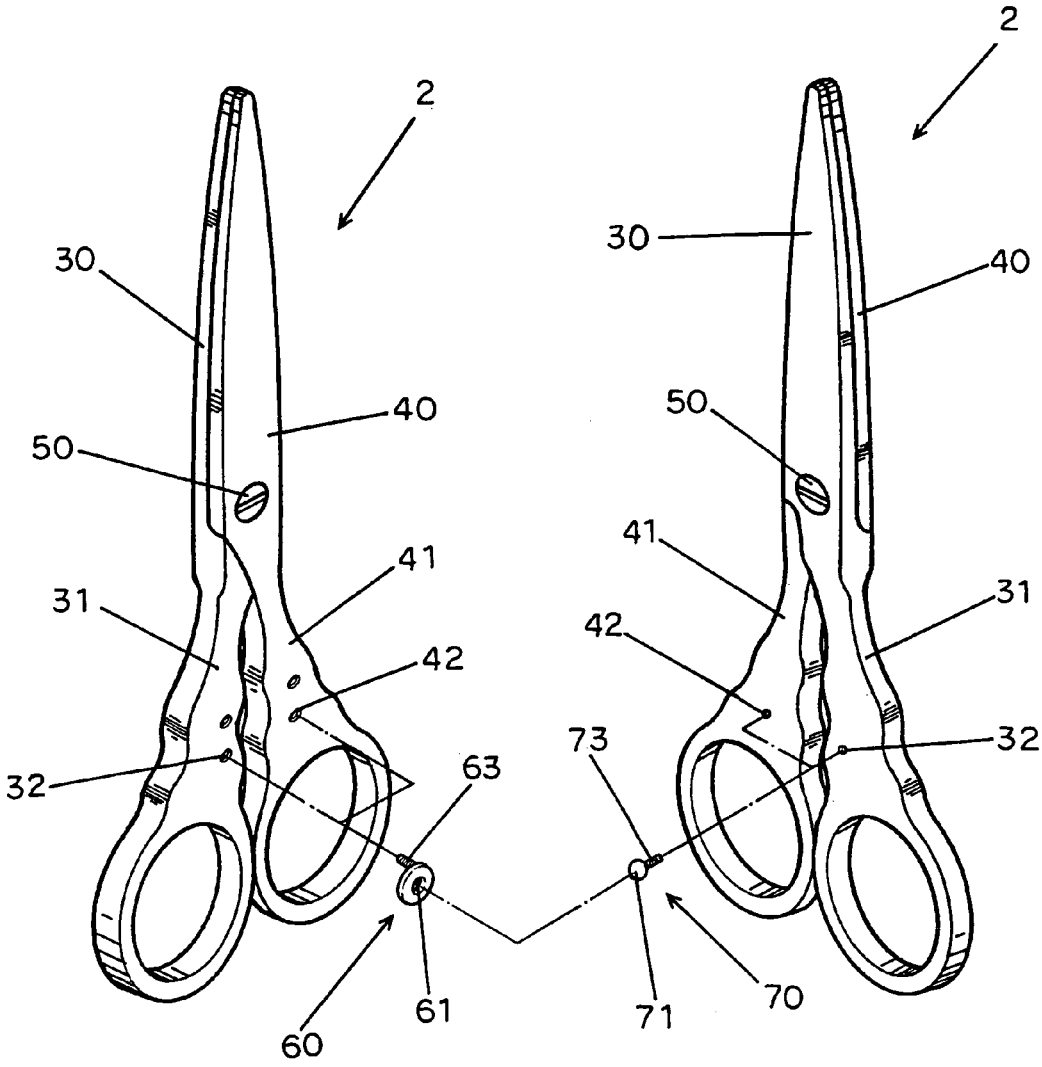
FIG. 1 is an exploded perspective view of a first embodiment of a hairdressing scissor assembly in accordance with the present invention.
Figure 2:
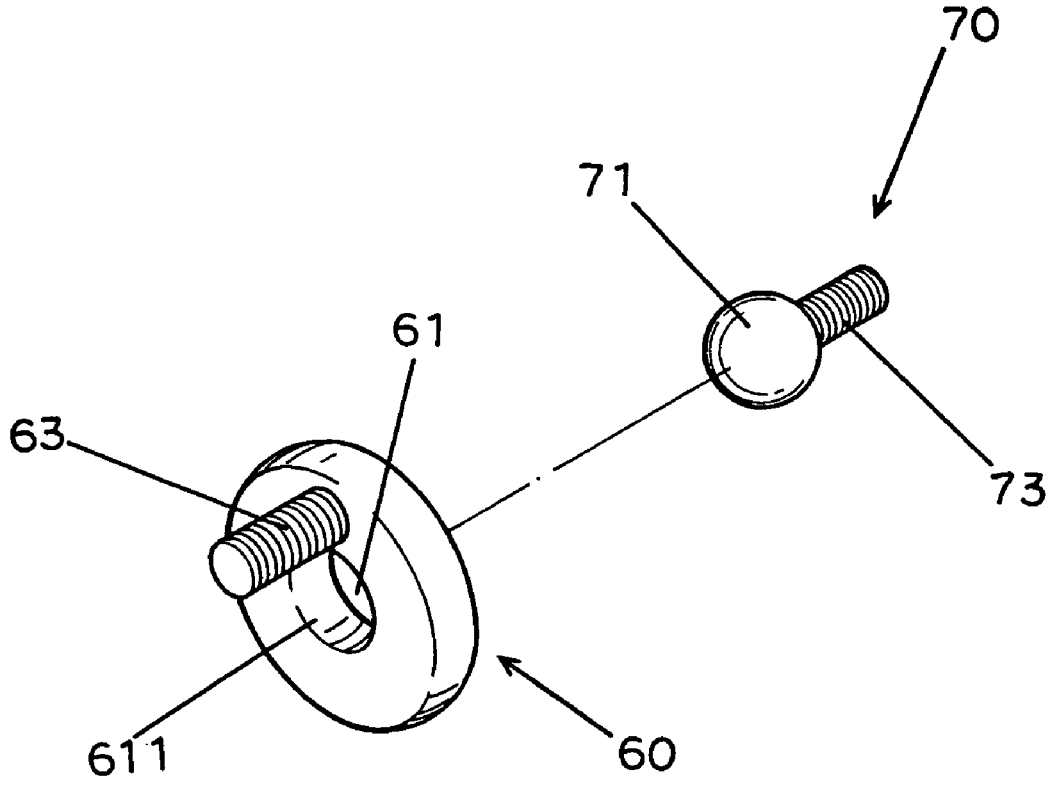
FIG. 2 is an exploded view of one male connector and one female connector of the first embodiment of the hairdressing scissor assembly in accordance with the present invention.

Referring to FIGS. 1 and 2, a first embodiment of a hairdressing scissor assembly in accordance with the present invention generally comprises plural pairs of hairdressing scissors 2 each having first and second cutting members 30 and 40 that are pivoted together by a pivot 50. The first cutting members 30 comprise a first handle 31 on an end thereof. The second cutting members 40 comprises a second handle 41 on an end thereof.

The first handle 31 comprises at least one first screw hole 32 defined in each of first and second sides thereof. The second handle 41 comprises at least one second screw hole 42 defined in each of first and second sides thereof.

At least one female connector 60 is respectively mounted in the first and second screw holes 32 and 42 at the first sides of the handles 31 and 41 of the first and second cutting members 30 and 40 of each pair of hairdressing scissors 2. At least one male connector 70 is respectively mounted in the first and second screw holes 32 and 42 at the second sides of the handles 31 and 41 of the first and second cutting members 30 and 40 of each pair of hairdressing scissors 2. Each female connector 60 comprises a through hole 61 and a screw rod 63. The screw rod 63 is threaded into the associating screw hole 32 or 42 at the first side of the associating pair of hairdressing scissors 2. Each male connector 70 comprises a screw rod 73 threaded into the associating screw hole 32 or 42 at the second side of the associating pair of hairdressing scissors 2, and a retaining block 71 fixedly provided at one end of the screw rod 73 and engageable into the through hole 61 at the first side of another pair of hairdressing scissors 2.

According to this embodiment, each female connector 60 and each male connector 70 are respectively fastened to the associating screw holes 32 and 42 by a respective screw joint. Alternatively, each female connector 60 and each male connector 70 can be bonded/welded to the handles 31 and 41 of the pairs of hairdressing scissors 2, or fixedly secured thereto by other conventional techniques.

Figure 3:
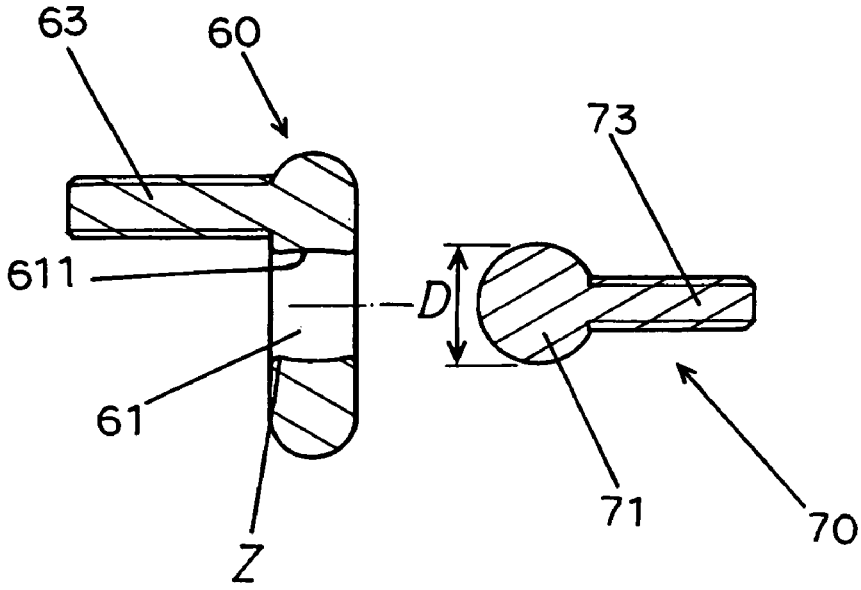
FIG. 3 is a sectional view of FIG. 2.
Figure 4:
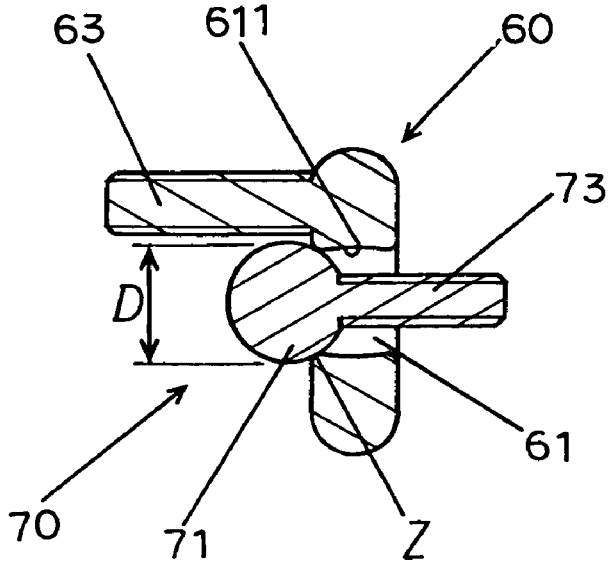
FIG. 4 is a sectional assembly view of FIG. 3.

Referring to FIGS. 3 and 4 and FIG. 2 again, the through hole 61 of each female connector 60 has a smoothly arched peripheral wall 611, and the retaining block 71 is a spherical block having the maximum outer diameter D slightly greater than the diameter of the smoothly arched through hole 61 of each female connector 60. Therefore, the spherical retaining block 71 can be inserted through the through hole 61 by force. When inserted through the through hole 61, the maximum outer diameter D of the retaining block 71 of the male connector 70 is stopped at one end edge Z of the through hole 61 of the associating female connector 60, and therefore the male connector 70 and the associating female connector 60 are secured together to join the two pairs of hairdressing scissors 2.

Figure 5:
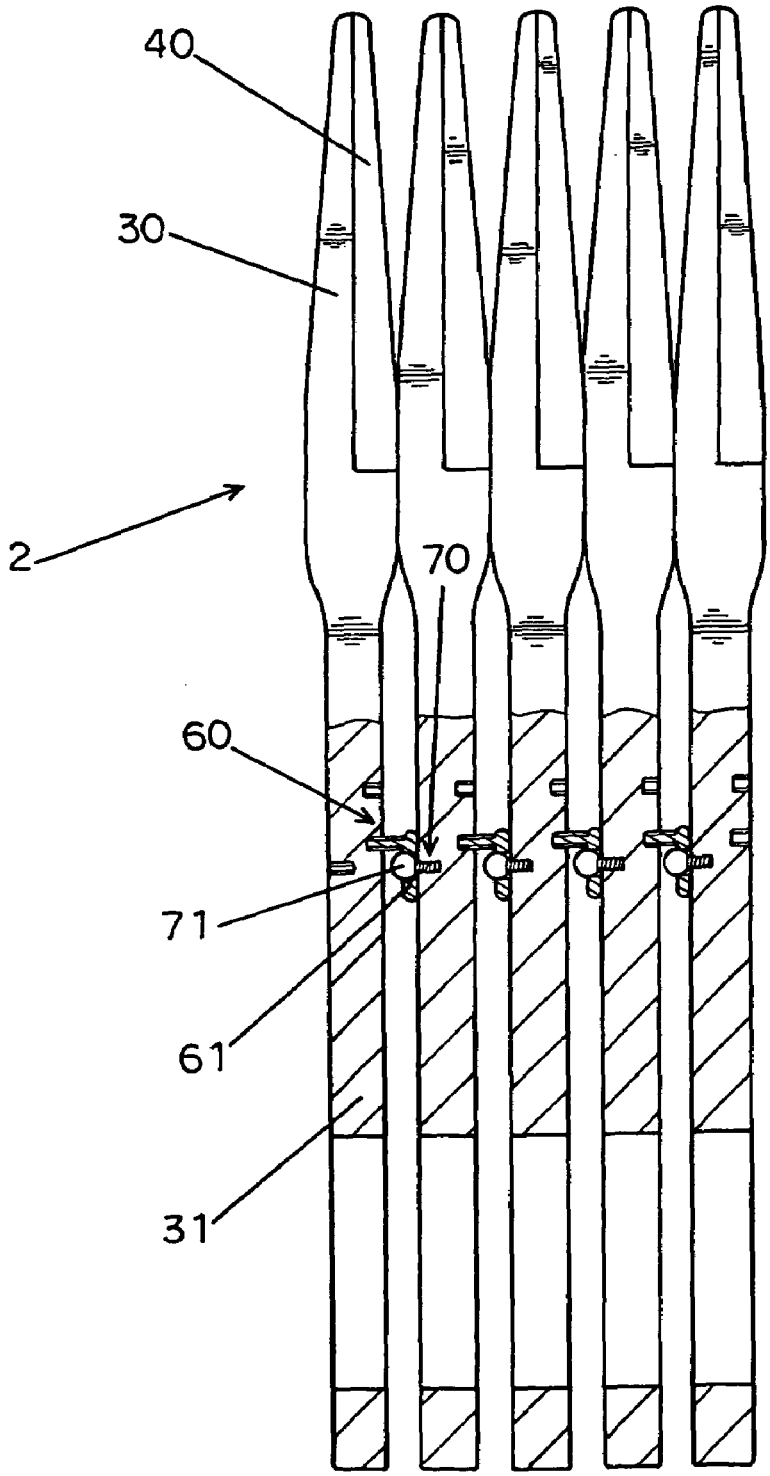
FIG. 5 is a sectional view of the first embodiment of the hairdressing scissor assembly in accordance with the present invention, wherein which the tips of the pairs of hairdressing scissors are aligned along a straight line and located at the same level.

The pairs of hairdressing scissors 2 in accordance with the present invention can be engaged with one another in a manner illustrated in FIG. 5, in which the tips of the pairs of hairdressing scissors 2 are aligned along a straight line and located at the same level.

Figure 6:
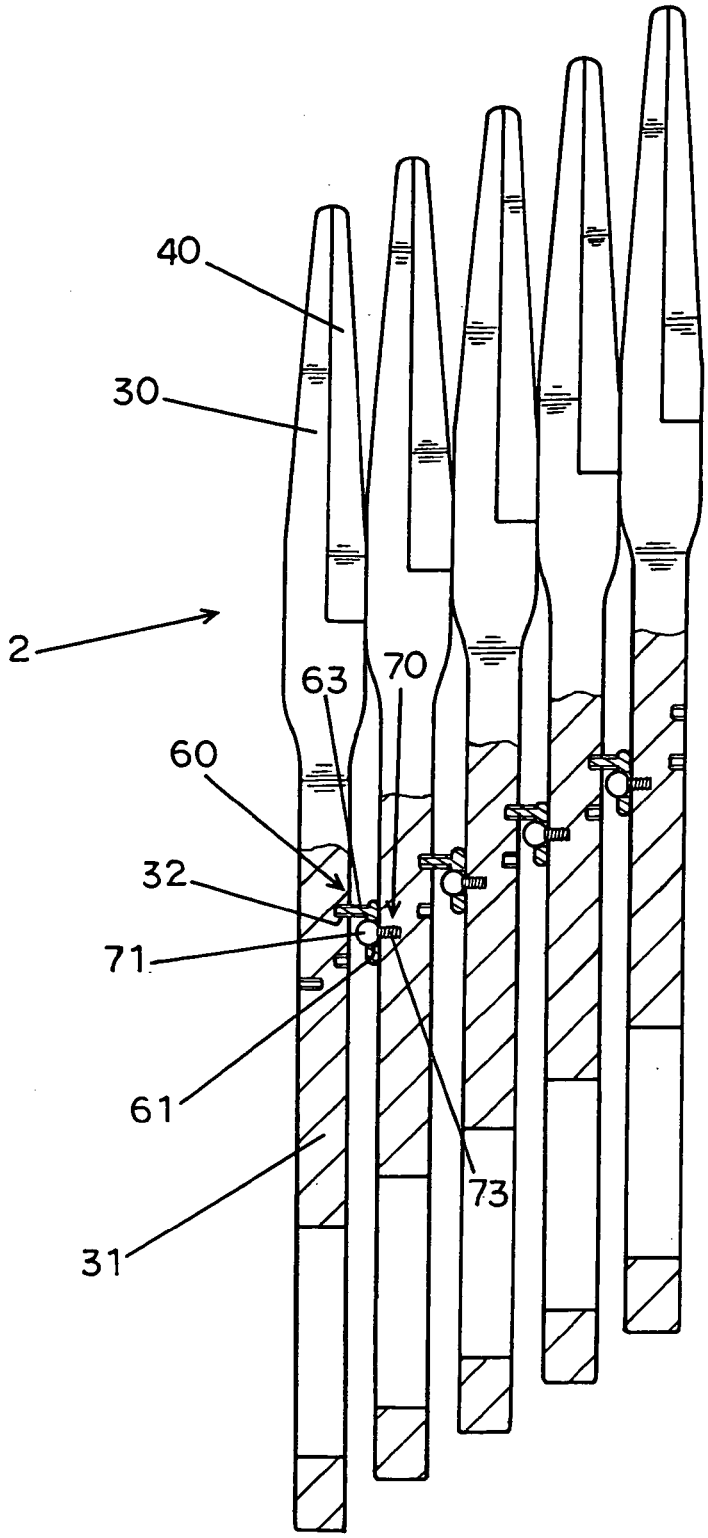
FIG. 6 is another sectional view of the first embodiment of the hairdressing scissor assembly in accordance with the present invention, wherein the tips of the pairs of hairdressing scissors are aligned along an inclined line and located at different levels.

Alternatively, the pairs of hairdressing scissors 2 in accordance with the present invention can be engaged with one another by selectively engaging each female connector 60 at the first side of each pair of hairdressing scissors 2 at a first elevation to the associating male connector 70 at the second side of another pair of hairdressing scissors 2 at a second elevation in a manner illustrated in FIG. 6, in which the tips of the pairs of hairdressing scissors 2 are aligned along an inclined line and located at different levels.

Figure 7:
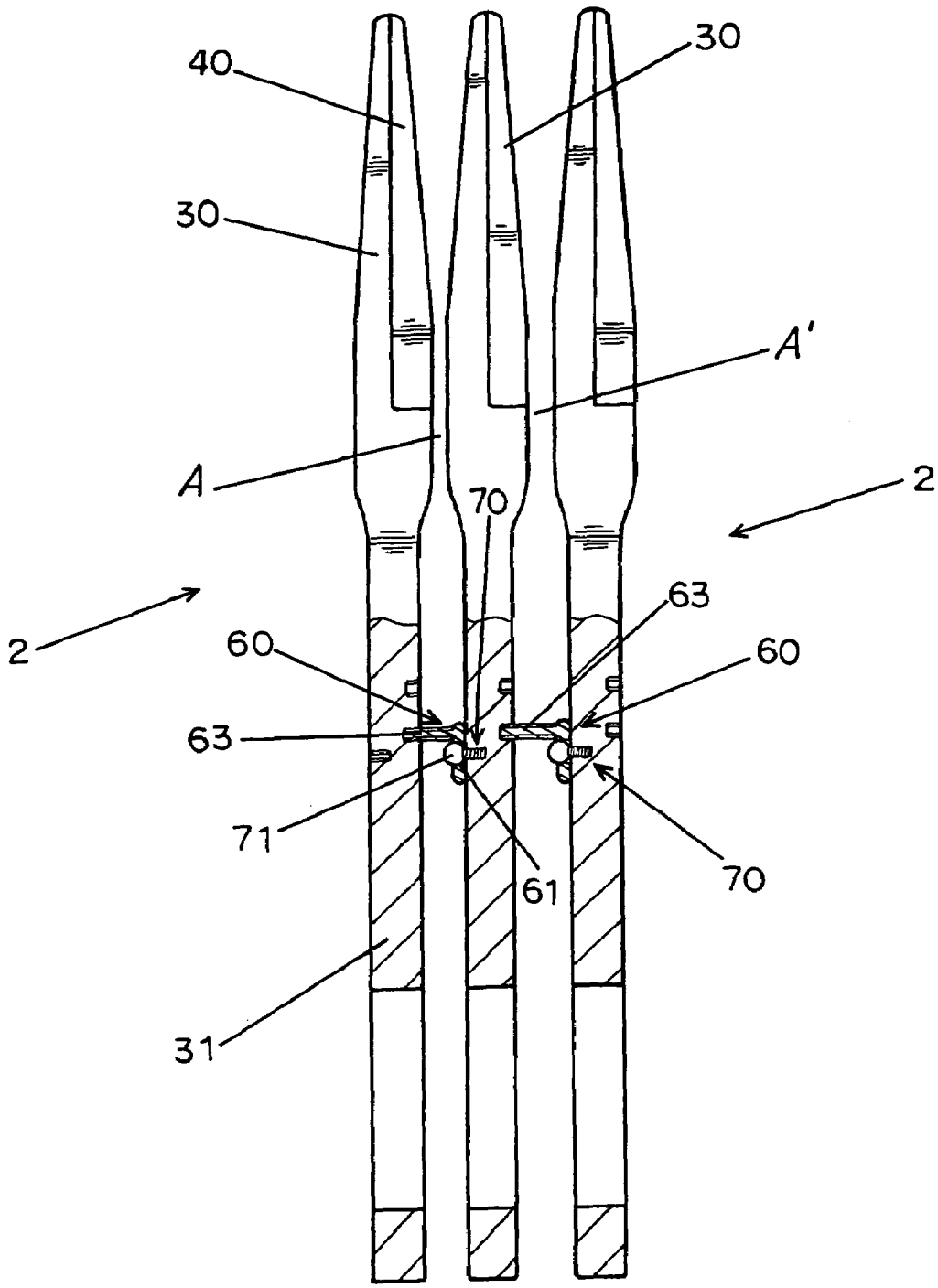
FIG. 7 is still another sectional view of the first embodiment of the hairdressing scissor assembly in accordance with the present invention, wherein the pairs of hairdressing scissors are joined together and kept spaced from one another at a different pitch.

Further, the screw rods 63 of the female connectors 60 at different pairs of hairdressing scissors 2 can be made having different lengths, so that the pairs of hairdressing scissors 2 can be secured together in a parallel manner and kept spaced from one another at different pitches A or A' as shown in FIG. 7. Alternatively, the screw rods 73 of the male connectors 70 at different pairs of hairdressing scissors 2 can be made having different lengths, so that the pairs of hairdressing scissors 2 can be secured together in a parallel manner and kept spaced from one another at different pitches.

Figure 8:
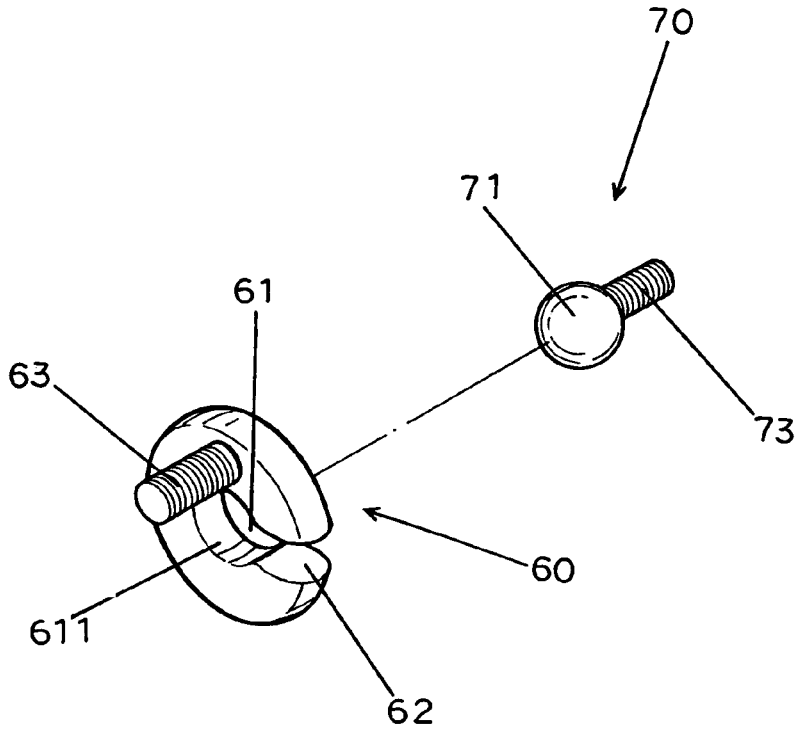
FIG. 8 is an exploded view of a female connector and a male connector according to a second embodiment of the present invention.
Figure 9:
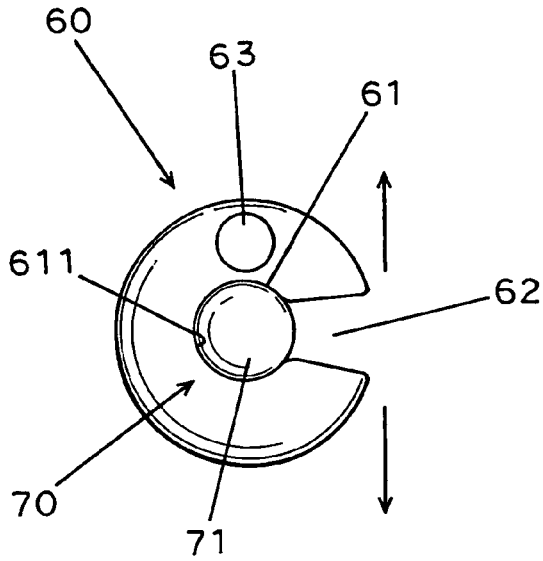
FIG. 9 is an assembly view of FIG. 8.

According to the second embodiment of the present invention as shown in FIGS. 8 and 9, the female connector 60 is shaped like a splitting ring having a radial crevice 62 radially extending from the through hole 61 to the periphery of the female connector 60. The radial crevice 62 has a width smaller than the diameter of the through hole 61. When forcing the spherical retaining block 71 of the associating male connector 70 through the though hole 61, the female connector 60 is stretched radially outwards to widen the radial crevice 62 for allowing the spherical retaining block 71 to pass through the through hole 61. After the spherical retaining block 71 passed through the through hole 61, the female connector 60 immediately returns to the former shape due to the effect of the resilient material property, and therefore the male connector 70 and the female connector 60 are fastened together.

Figure 10:
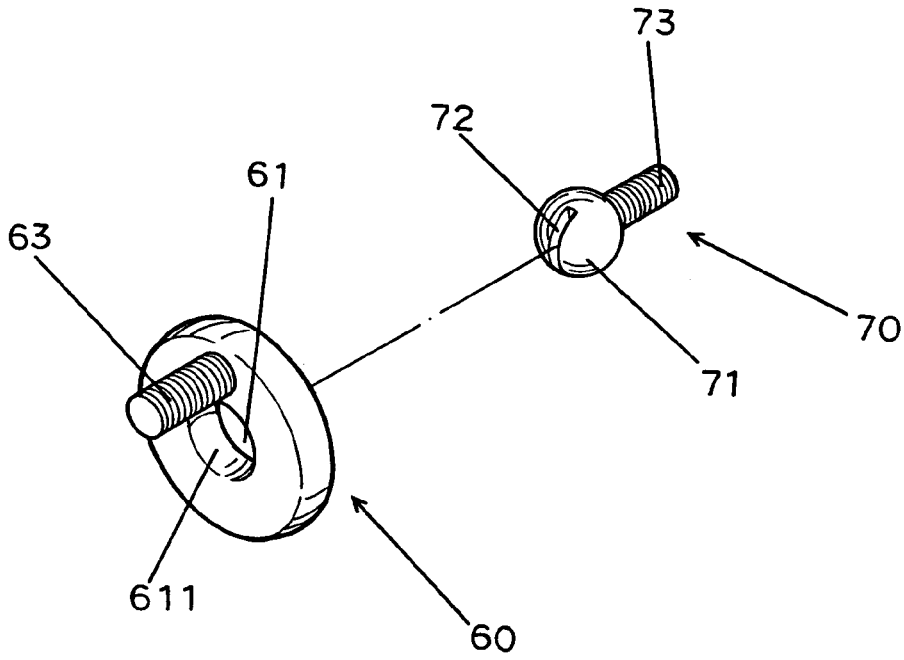
FIG. 10 is an exploded view of a female connector and a male connector according to a third embodiment of the present invention.
Figure 11:
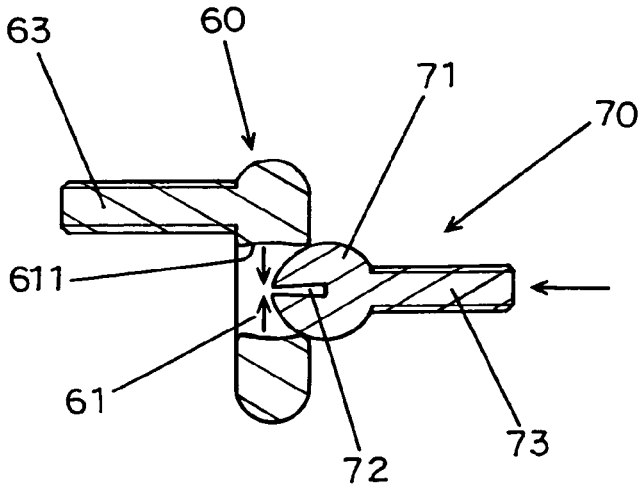
FIG. 11 is a sectional assembly view of FIG. 10.
Figure 12:
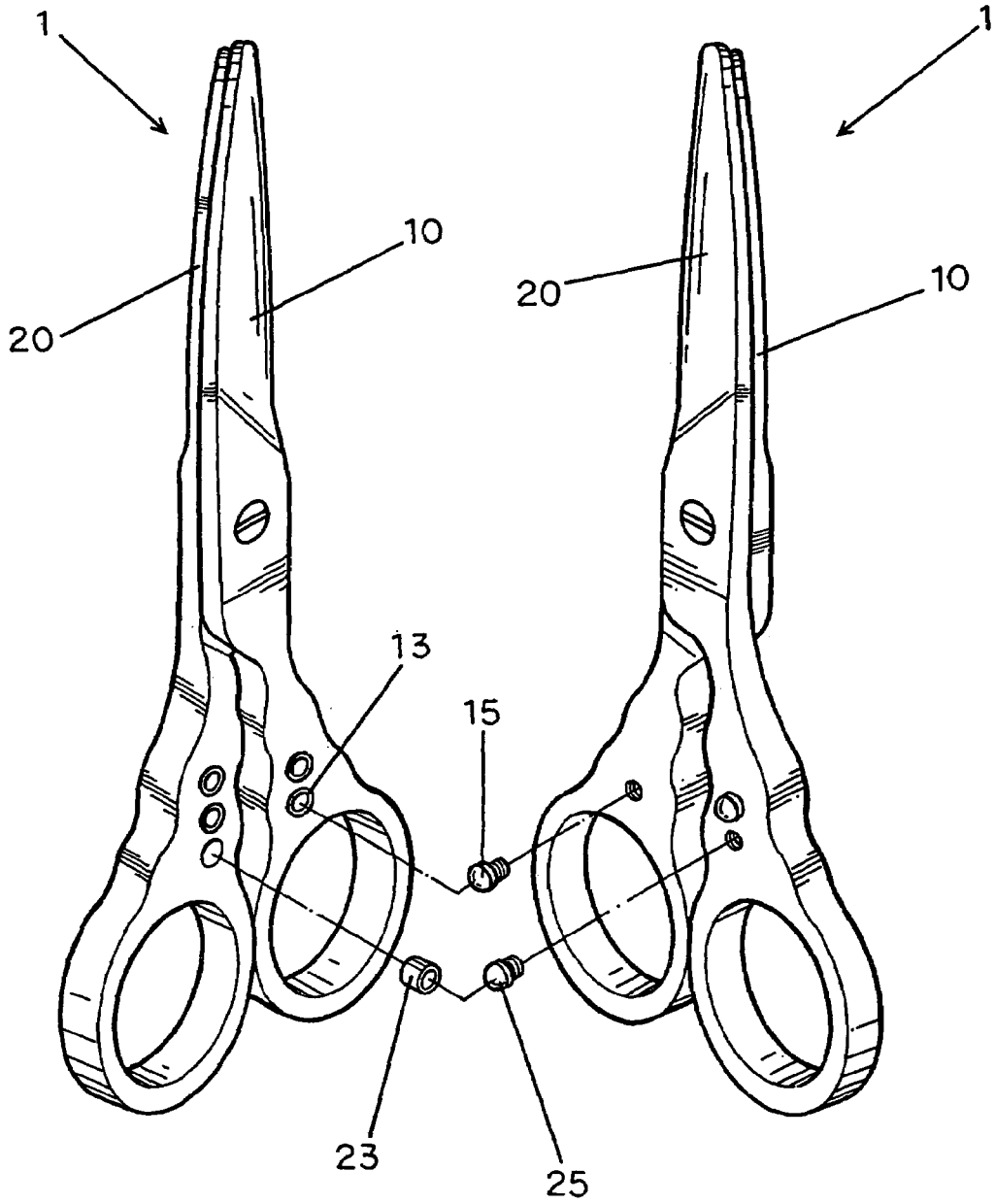
FIG. 12(Prior Art)
FIG. 12 is an exploded view of a hairdressing scissor assembly according to the prior art.

According to the third embodiment of the present invention as shown in FIGS. 10 and 11, the spherical retaining block 71 of the male connector 70 is a block having a radial concave 72. Therefore, the spherical retaining block 71 is radially compressible and can conveniently be forced through the through hole 61 of the associating female connector 60. When forcing the spherical retaining block 71 through the through hole 61, the spherical retaining block 71 is radially compressed to narrow the radial concave 72 for enabling the spherical retaining block 71 to pass through the through hole 61 smoothly. After the spherical retaining block 71 passed the through hole 61, the spherical retaining block 71 immediately returns to the former shape due to the effect of the resilient material property, and the maximum outer diameter D of the spherical retaining block 71 is stopped outside the through hole 61, and therefore the female connector 60 and the associating male connector 70 are fastened together.

As indicated above, each pair of hairdressing scissors 2 of the hairdressing scissor assembly has at least one female connector 60 at the first side and at least one male connector 70 at the second side, and by means of selectively fastening the at least one female connector 60 at one pair of hairdressing scissors 2 to the at least one male connector 70 at another pair of hairdressing scissors 2, plural pairs of hairdressing scissors 2 are joined together, forming a hairdressing scissor assembly for cutting or thinning the hair to form the desired hairstyling design. Further, the through hole 61 of each female connector 60 is a circular through hole, and the retaining block 71 of each male connector 70 is a spherical retaining block conveniently for forcing through the circular through hole 61 of the associating female connector 60. When separating the joined pairs of hairdressing scissors 2, the user needs only to apply a pressure to the pairs of hairdressing scissors 2 to force the respective male connectors 70 away from the respective female connectors 60.

Therefore, the hairdressing scissor assembly of the present invention has the following features:

1. The retaining block 71 of each male connector 70 has a diameter D slightly greater than the diameter of the through hole 61 of each female connector 60, so that the maximum outer diameter D of the retaining block 71 of each male connector 70 can be stopped at one end edge Z of the through hole 61 of the associating female connector 60 when forced through the through hole 61 of the associating female connector 60, keeping the pairs of hairdressing scissors 2 positively joined together.

2. The screw rods 63 of the female connectors 60 or the screw rods 73 of the male connectors 70 can be made having different lengths, so that the pairs of hairdressing scissors 2 can be joined together and kept spaced from one another at different pitches A or A'.

Although particular embodiments of the invention have been described in detail for purposes of illustration, various modifications and enhancements may be made without departing from the spirit and scope of the invention.

What the invention claimed is:

1. A hairdressing scissor assembly comprising plural pairs of hairdressing scissors, said plural pairs of hairdressing scissors each comprising a first cutting member and a second cutting member pivotally connected together, said first cutting member and said second cutting member each having a first side and a second side opposite to said first side, at least one female connector respectively secured to at least one of the first and second cutting members of each of said plural pairs of hairdressing scissors at the first side, and at least one male connector respectively secured to at least the other of the first and second cutting members of each of said plural pairs of hairdressing scissors at the second side, wherein said at least one female connector each comprises a through hole; said at least one male connector comprises a retaining block, said retaining block having the maximum outer diameter insertable through the through hole of one of said at least one female connector and stoppable outside the through hole to have the respective male connector and the respective female connector be fastened together, and wherein the retaining block of each of said at least one male connector is a spherical block, and the through hole of each of said at least one female connector is a circular through hole.

2. The hairdressing scissor assembly as claimed in claim 1, wherein the through hole of each of said at least one female connector has a smoothly arched cross section.

3. The hairdressing scissor assembly as claimed in claim 1, wherein each of said at least one female connector has a radial crevice radially extending from the through hole of the respective female connector to the periphery of the respective female connector.

4. The hairdressing scissor assembly as claimed in claim 1, wherein the retaining block of each of said at least one male connector is a block having a radial concave.

5. The hairdressing scissor assembly as claimed in claim 1, wherein the maximum outer diameter of the retaining block of each of said at least one male connector is not smaller than the diameter of the through hole of each of said at least one female connector.

* * * * *